United States Patent [19]

Candor

[11] 3,965,594

[45]*June 29, 1976

[54] FRAME CONSTRUCTION FOR A PLURAL PAGE DOCUMENT

[76] Inventor: James T. Candor, 5440 Cynthia Lane, Dayton, Ohio 45429

[ * ] Notice: The portion of the term of this patent subsequent to Apr. 30, 1991, has been disclaimed.

[22] Filed: Sept. 23, 1974

[21] Appl. No.: 508,084

Related U.S. Application Data

[63] Continuation of Ser. No. 374,936, June 29, 1973, abandoned, which is a continuation-in-part of Ser. No. 336,989, March 1, 1973, Pat. No. 3,807,071, which is a continuation-in-part of Ser. No. 271,925, July 14, 1972, abandoned.

[52] U.S. Cl. ..... 40/104.02; 40/152

[51] Int. Cl.[2] ..... G09F 1/12

[58] Field of Search ..... 40/10 R, 152, 158, 159, 40/124, 124.2, 104.18, 102, 104.02; 283/156, 15 R

[56] References Cited

UNITED STATES PATENTS

| | | | |
|---|---|---|---|
| 777,082 | 12/1904 | Cutler | 40/10 R |
| 1,626,150 | 4/1927 | Parda | 40/104.18 |
| 1,715,533 | 6/1929 | Bowerstock | 40/10 R |
| 2,547,673 | 4/1951 | Thomason | 40/10 R |
| 2,757,022 | 7/1956 | Young, Jr. | 281/15 B |
| 2,872,215 | 2/1959 | Taylor | 40/10 R |
| 3,283,421 | 11/1966 | Schott | 40/10 R |

FOREIGN PATENTS OR APPLICATIONS

| | | | |
|---|---|---|---|
| 1,081,233 | 6/1954 | France | 281/15 B |
| 1,161,858 | 3/1958 | France | 40/10 R |
| 904,038 | 2/1945 | France | 40/152 |

OTHER PUBLICATIONS

Book Production Industry, Dec. 1966, pp. 41–42.

*Primary Examiner*—Hugh R. Chamblee
*Assistant Examiner*—John H. Wolff
*Attorney, Agent, or Firm*—Candor, Candor & Tassone

[57] ABSTRACT

A picture-like frame construction for exhibiting a plural page document and having a back support for supporting the frame construction in a substantially vertical manner on a wall, desk, etc. The back support has a clamping channel member adjacent the top thereof for defining at least part of an open area within the frame construction and leading from the front thereof to the back support and clamping and holding adjacent top parts of the pages of the document in serial hinged stacked relation in the channel thereof so that the pages are disposed in stacked relation in the open area in such a manner that the outer most page appears to be the only page framed in the open area but permitting all of the pages to be manually fanned out through the open area thereof for individual viewing thereof.

7 Claims, 15 Drawing Figures

FRAME CONSTRUCTION FOR A PLURAL PAGE DOCUMENT

This application is a continuation application of its copending parent application, Ser. No. 374,936, filed June 29, 1973, now abandoned, which in turn, is a continuation-in-part application of its copending parent patent application, Ser. No. 336,989, filed Mar. 1, 1973, now U.S. Pat. No. 3,807,071 which, in turn, is a continuation-in-part application of its copending parent patent application, Ser. No. 271,925, filed July 14, 1972 now abandoned.

This invention relates to a frame construction that can be utilized for framing a plural page document, the frame construction being adapted to be mounted on a vertical wall, desk, or other desired supporting structure in a manner similar to a conventional picture frame.

It is well known that frame constructions have been provided for pictures and the like wherein the item being framed is disposed in a window area behind a glass panel or is merely exposed at the window area thereof. In any event, the item being framed is held stationary in the frame by the structure of the frame.

However, according to the teachings of this invention, a frame construction is provided for a plural page document wherein each page of the document can be individually viewed in the frame construction by the viewer merely fanning out the pages thereof which are normally held in a hinged stacked relation in an open area of the frame construction of this invention.

In particular, one embodiment of this invention provides a picture-like frame construction for exhibiting a plural page document and having a back support for supporting said frame construction in substantially a vertical manner on a wall, desk, etc. The back support has a clamping channel means adjacent the top thereof for defining at least part of an open area within the frame construction and leading from the front thereof to the back support and for clamping and holding adjacent top parts of the pages of the document in serial hinged stacked relation in the channel thereof so that the pages are disposed in serial stacked relation in said open area in such a manner that the outermost page appears to be the only page framed in the open area but permitting all of the pages to be manually fanned out through the open area thereof for individual viewing thereof.

Accordingly, it is an object of this invention to provide an improved frame construction having one or more of the novel features set forth above or hereinafter shown or described.

Other objects, uses, and advantages of this invention are apparent from a reading of this description, which proceeds with reference to the accompanying drawings forming a part thereof and wherein.

Figure 1:
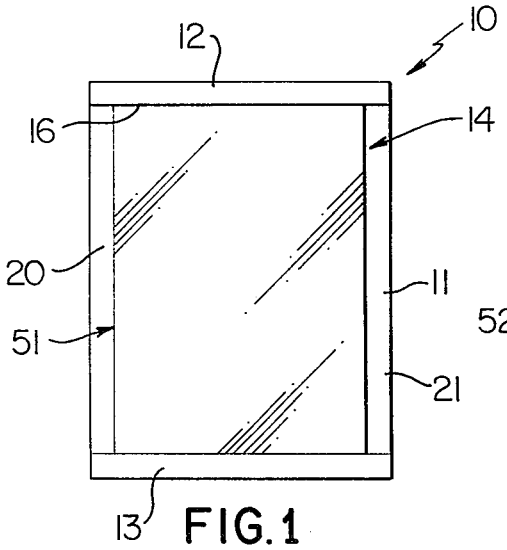
FIG. 1 is a front view of one embodiment of the improved frame construction of this invention.

While the various features of this invention are hereinafter described and illustrated as being particularly adapted for framing a plural page document, it is to be understood that the various features of this invention can be utilized singly or in any combination thereof to provide framing means for single page documents or other structures as desired, such as single or several photographs and the like.

Therefore, this invention is not to be limited to only the embodiments illustrated in the drawings, because the drawings are merely utilized to illustrate one of the wide variety of uses of this invention.

Figure 2:
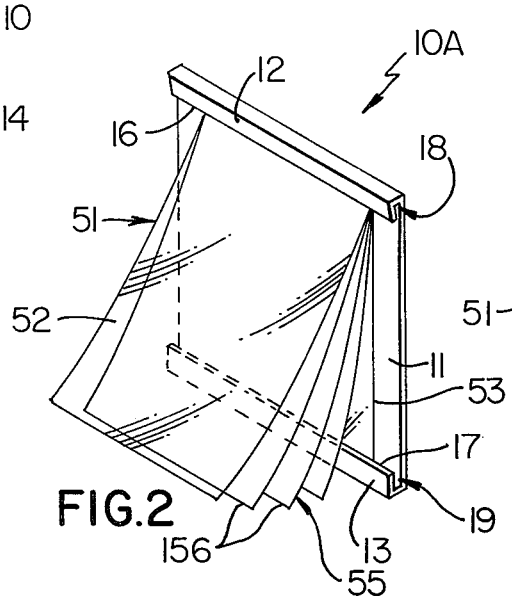
FIG. 2 is a side perspective view of the frame construction of FIG. 1 and illustrates the manner of fanning out the various pages of a plural page document framed thereby for individual viewing thereof.

Referring now to FIGS. 1 and 2, the improved frame construction of this invention is generally indicated by the reference numeral 10 and comprises a flat back support 11 formed in a rectangular configuration and having top and bottom integral channel means 12 and 13 integrally formed therewith and defining a substantially rectangular open area 14 within the outer periphery of back support 11 and which leads from the front of the frame construction 10 to the rear support 11 thereof.

Figure 3:
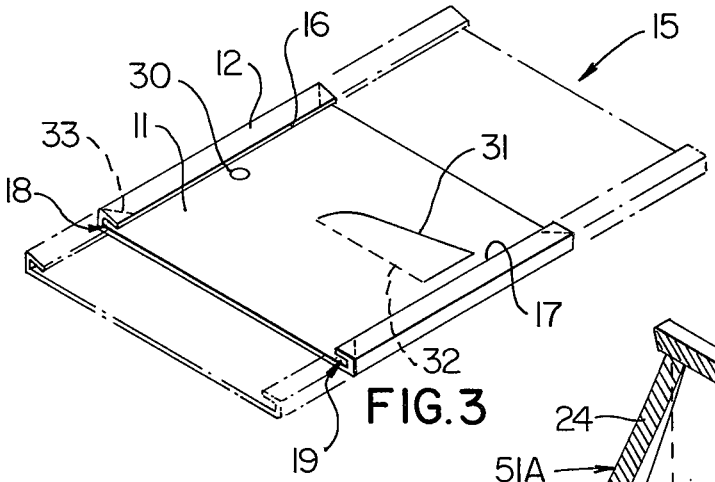
FIG. 3 is a perspective view illustrating the frame construction of FIG. 1 without having the plural page document framed therein.

If desired, the back support 11 and integral channel means 12 and 13 thereof can be formed of extruded plastic material in a continuous manner as illustrated in FIG. 3 wherein each back support 11 can be cut from a continuous strip extrusion that is illustrated in phantom lines in FIG. 3 and generally indicated by the reference numeral 15.

The upper channel member 12 forms a clamping channel means wherein the front flange 16 thereof has a natural resiliency to bend toward the back support 11 whereas the front flange 17 of the bottom channel member 13 has a natural tendency to remain fully spaced from the back support 11 as will be apparent hereinafter.

Figure 4:
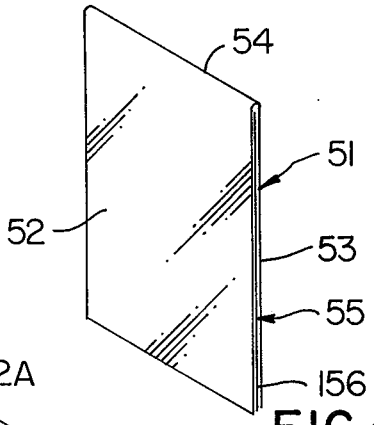
FIG. 4 is a side perspective view of a plural page document and a transparent covering member therefor that is adapted to be framed in the frame construction of FIG. 3 to produce the frame construction of FIG. 1.

A folded over transparent flexible plastic sheet means that is generally indicated by the reference numeral 51 in FIG. 4 defines a front transparent sheet 52 and a back transparent sheet 53 that are hinged together at an integral fold 54 at the upper ends thereof and is adapted to receive therebetween a plural page document that is generally indicated by the reference numeral 55 and comprising a plurality of pages 156 either fastened together at the upper edges thereof or remaining loose but disposed in serial stacked relation, with the upper edges being disposed inside but adjacent the fold 54 of the transparent sheet means 51.

As illustrated, the transparent sheet means 51 has a width substantially equal to the width of the pages 156 with the front and back sheets 52 and 53 thereof being substantially of the same length of the pages 156 of the plural page document 55 when the same is assembled within the transparent sheet means 51 in the manner illustrated in FIG. 4.

Figure 5:
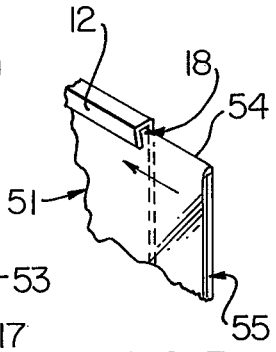
FIG. 5 is a fragmentary, perspective view of the frame construction of FIG. 1 and illustrates the manner of inserting the carrier means of FIG. 4 in the frame part of FIG. 3.

The thus assembled transparent sheet means 51 and pages 156 of the document 55 are adapted to be assembled to the back support 11 to form the frame construction 10 of FIG. 1 by slipping the fold 54 of the sheet means 51 into the channel 18 of the upper channel means 12 in the manner illustrated in FIG. 5 until the sheet means 51 is fully centered within the upper channel means 12 in the manner illustrated in FIG. 1 whereby the flange 16 of the upper channel means 12 holds the assembled sheet means 51 and document 55 to the back support 11 and the lower parts of the transparent sheets 52 and 53 and the pages 156 of the plural page document 55 can be inserted downwardly into the channel 19 of the lower channel means 13 in the manner illustrated in FIG. 1. Thus, the pages 156 of the plural page document 55 are held in serial stacked relation at the tops and bottom thereof in the open area 14 of the frame construction 10 so that the outermost page 156 of the plural page document 55 appears to be the only page being framed by the frame construction 10 and the outer sheet 52 of the transparent sheet means 51 fully covers such outermost page 156 of the plural page document 55 to give the appearance that the same is being covered by a rectangular glass panel as illustrated in FIG. 1.

By so sizing the width of the transparent sheet means 51 in relation to the width of the channel means 12 and 13 of the back support 11, it can be seen that the exposed side parts 20 and 21 of the back support 11 that are disposed outboard of the respective side areas 22 and 23 of the outermost transparent sheet 52 of the sheet means 51 when viewing the frame construction 10 in the direction of FIG. 1 gives the appearance that the same are framing members similar to the framing members 12 and 13 of the back support 11 so that the exposed part of the outermost sheet 52 gives the appearance of being completely framed not only within the top and bottom framing members 12 and 13 but also by the opposed side framing members 20 and 21 even though the members 20 and 21 are merely exposed parts of the back support 11.

Thus, by forming the integral extrusion 11 with a desired color and appearance, such as by being all black, or grained to look like wood, etc., the one piece extrusion 11 when utilized with the transparent sheet means 51 in combination with the plural page document 55, will give the appearance that a single sheet is being framed by the frame construction 10 in much the same manner as a conventional picture-like frame construction that has a glass panel in front of the sheet being framed thereby.

However, because the lower parts of the pages 156 of the plural page document 55 and the lower part of the outer sheet 52 of the sheet means 51 can be readily lifted from the channel 19 of the bottom channel means 13 through the bowing out of the sheet 52 and pages 156, the same can be outwardly fanned in the manner illustrated in FIG. 2 for individual viewing of the sheets 156 in a serial manner for any of the reasons fully set forth in the aforementioned pending patent applications. After the pages 156 have been viewed in the manner illustrated in FIG. 2, either while the frame construction is disposed on a wall or after the same has been removed therefrom, etc., the pages 156 can have the bottoms thereof reinserted in the channel 19 of the lower channel means 13 to cause the frame construction 10 to be replaced back into the condition illustrated in FIG. 1 and thereby indicate that only a single page is being framed thereby Therefore, it can be seen that it is a relatively simple matter to frame a plural page document with the frame construction 10 of this invention as the plural page document is merely slipped in between the front and back sheets 52 and 53 of the transparent sheet means 51 and such assembled sheet means 51 is readily insertible at the fold 54 thereof in the upper channel 18 of the upper channel means 12 whereby the upper channel means 12 fully clamps the folded part 54 of the assembled sheet means 51 and the tops of the pages 156 therein in serial stacked hinged relation as illustrated in FIGS. 1 and 2 to permit the plural page document 55 to have the pages 156 individually viewed when desired and to give the appearance that only the outer sheet thereof is being framed in the manner illustrated in FIG. 1.

While any suitable means can be fastened to the rear of the back support 11 for hanging the frame construction 10 on a wall or for supporting the same in a substantially vertical position on a desk or the like, it is to be understood that the back support 11 can be provided with one or more holes 30 in the manner illustrated in FIG. 3 for such purpose and/or the back support 11 can have a suitable cutout 31 formed therethrough to be subsequently folded rearwardly along a fold line 32 to support the frame construction 10 in a substantially vertical position on a desk or the like in the manner of a conventional frame construction.

However, it is also to be understood that the frame construction 10 of this invention can be utilized for a purpose wherein it is never intended that the frame construction 10 be mounted on a wall or desk, etc., as the frame construction 10 can be utilized merely for support means of a plural page report or the like to facilitate a person in hand holding such report for individual use thereof or even for giving a speech as the frame construction 10 can hold the plural pages of a speech that is to be orally given whereby a lectern may not be needed.

In particular, by hand holding the back support 11 the individual pages 156 can be folded back over the top of the channel means 12 against the rear of the back support 11 after each page has been utilized in either a reading or speech giving manner.

In this connection, while the channel means 12 and 13 have heretofore and hereinafter been referred to as top and bottom channel means, it is to be understood that the same could also be utilized as side channel means as the parts 20 and 21 of the frame construction 10 could then form the top and bottom of such frame construction 10 whereby the plural page document could be viewed in much the same manner that the pages of a book are turned for review or reading thereof.

In order to further simulate that the frame construction 10 has the sheet means 51 and assembled document 55 completely framed by framing means bordering the transparent sheet means 51, the left and right ends of the upper and lower channel means 12 and 13 can be cut away along the angled dotted lines 33 indicated in FIG. 3 so that the parts 2, 13, 20 and 21 have the appearance of having been mitered at the corners thereof in much the same manner as a conventional picture frame.

Also, the back support 11 could be provided with integral foldable extensions at the side portions 20 and 21 thereof that could be folded back upon themselves after the assembled sheet means 51 and document 55 had been inserted therein in the manner illustrated in FIG. 5 to form three dimensional framing members at the sides 20 and 21, if desired.

While the transparent sheet means 51 has been described as having two equally sized front and back flexible sheets 52 and 53 joined at the fold 54 thereof, it is to be understood that the back sheet 53 need not extend all the way down to the lower edges of the pages 156 as the same merely needs to provide sufficient material at the fold 54 to facilitate the insertion of the assembled sheet means 52 and document 55 into the channel 18 of the upper channel means 12 as illustrated in FIG. 5.

If desired, the transparent sheet means 51 can have the outer sheet 52 thereof provided with framing-like material on the outer side edges 22 and 23 thereof to cooperate with the back support 11 in simulating a completely framed single sheet while still permitting individual viewing of a plurality of sheets of a plural page document.

Figure 6:
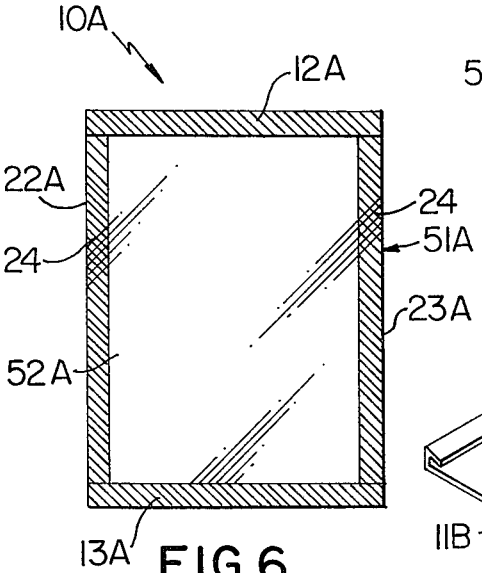
FIG. 6 is a view similar to FIG. 1 and illustrates another embodiment of the frame construction of this invention.
Figure 7:
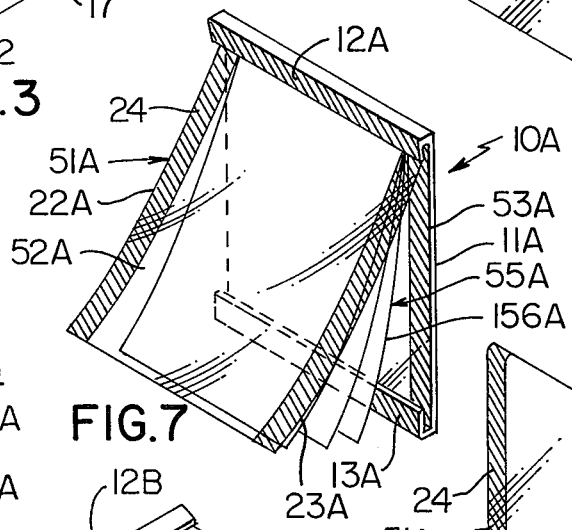
FIG. 7 is a side, perspective view of the frame construction of FIG. 6 and illustrates the manner of fanning out the various pages of the plural page document framed thereby for individual viewing thereof.
Figure 8:
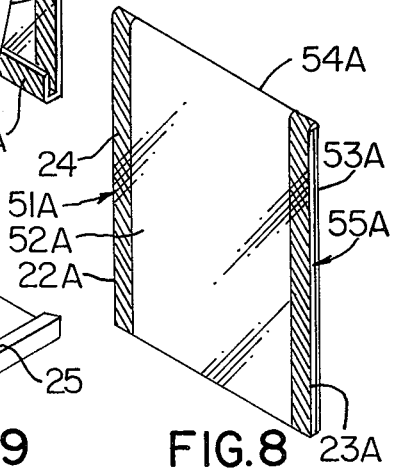
FIG. 8 is a view similar to FIG. 4 and illustrates the carrier means for the plural page document to be framed in the frame construction of FIG. 6.

In particular, another embodiment of the frame construction of this invention is generally indicated by the reference numeral 10A in FIGS. 6–8 and parts thereof similar to the frame construction 10 previously described are indicated by like reference numerals followed by the reference letter A.

As illustrated in FIGS. 6–8, the frame construction 10A includes the back support 11A having the top and bottom channel means 12A and 13A formed integrally therewith and performing their function in the same manner as the channel means 12 and 13 previously described. However, the transparent sheet means 51A for the frame construction 10A has at least the front sheet 52A thereof provided with strips 24 of coloring along the side edges 22A and 23A thereof similar to the coloring of the channel means 12 and 13 and of a width equal to the width of the top and bottom channel means 12 and 13 so that when the plural page document 55A is inserted within the front and back sheets 52A and 53A of the transparent sheet means 51A in the manner illustrated in FIG. 8 and the assembled transparent sheet means 51A has the fold 54A thereof inserted within the channel of the upper channel means 12 in the manner previously described, the width of the transparent sheet means 51A is substantially identical to the back support 11A so that the strips 24 on the front transparent sheet 52A cooperate with the upper and lower channel means 12A and 13A in the manner illustrated in FIG. 6 to give the appearance that the outermost page 156A of the plural page document 55A is completely framed within top and bottom and opposed side frame members in the manner illustrated in FIG. 5, even though the opposed side frame members actually comprise the color strips 24 on the outer sheet 52A of the transparent sheet means 51A that correspond to the same color and appearance of the top and bottom channel means 12A and 13A of the back support 11A.

However, when it is desired to view the various pages 156A of the plural page document 55A, the pages 156A are adapted to be fanned out in the manner illustrated in FIG. 7 by merely removing the lower parts of the pages 156 and outer sheet 52A from the lower channel member 13A in the manner previously described for individual viewing thereof.

It is obvious that both frame constructions 10 and 10A could be utilized with a single page rather than with a plural page document as the single page and the outer covering transparent sheet could have the lower edges thereof remaining in the lower channel means without any need for lifting the same out of the lower channel means for fanning out of the single page and the outer transparent sheet.

Figure 9:
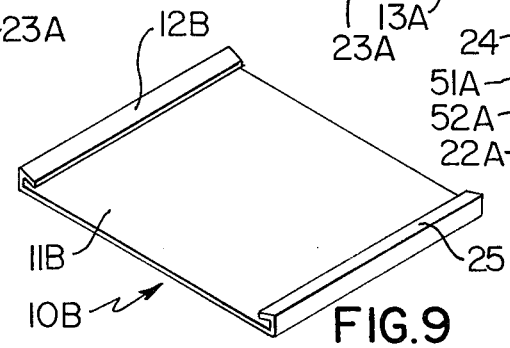
FIG. 9 is a perspective view of another frame construction of this invention without having a plural page document framed therein.

In fact, for a single page framing arrangement, the frame construction of this invention could have the lower channel means thereof formed in a clamping manner similar to the upper clamping channel means and reference is now made to FIG. 9 wherein such frame construction of this invention is generally indicated by the reference numeral 10B and parts thereof similar to the frame constructions 10 and 10A previously described are indicated by like reference numerals followed by the reference letter B.

As illustrated in FIG. 9, the frame construction 11B comprises the one piece back support 11B having the upper clamping channel means 12B at the upper end thereof and a similar clamping channel means 25 at the lower end thereof whereby the clamping channel means 12B and 25 clamp both the top and bottom edges of the transparent sheet means and assembled page therein as the transparent sheet means could have a top and bottom fold for facilitating the slipping of the same into the top and bottom channels 12B and 25 in the same manner as illustrated in FIG. 5 since the frame construction 10B is to be utilized for a single document and it is not necessary to fan out the items being framed thereby.

While the frame constructions 10, 10A, and 10B previously described have the top and bottom channel means thereof disposed at the outer peripheral edge of the backing member 11 and are formed integrally therewith, it is to be understood that separate channel means can be utilized at top and bottom parts of an open area with the channel means being mounted on a larger back support if desired.

In particular, another frame construction of this invention is generally indicated by the reference numeral 10C in FIGS. 10–14 and parts thereof similar to the parts of the frame constructions 10, 10A and 10B are indicated by like reference numerals followed by the reference letter C.

Figure 10:
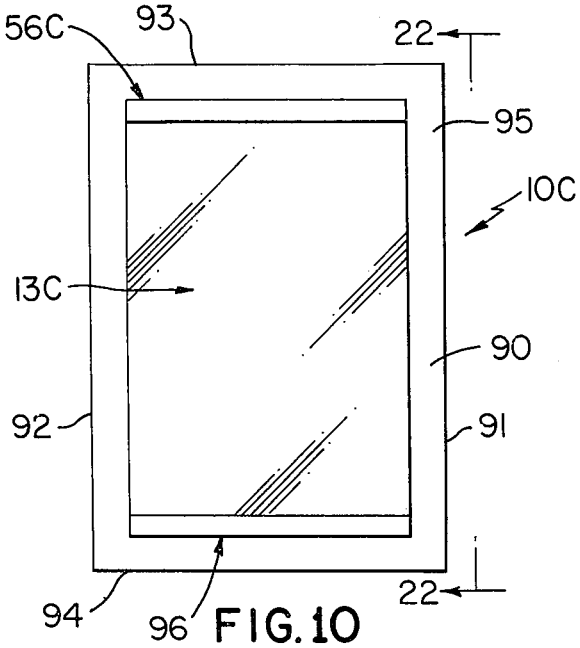
FIG. 10 is a view similar to FIG. 1 and illustrates another embodiment of the frame construction of this invention.
Figure 11:
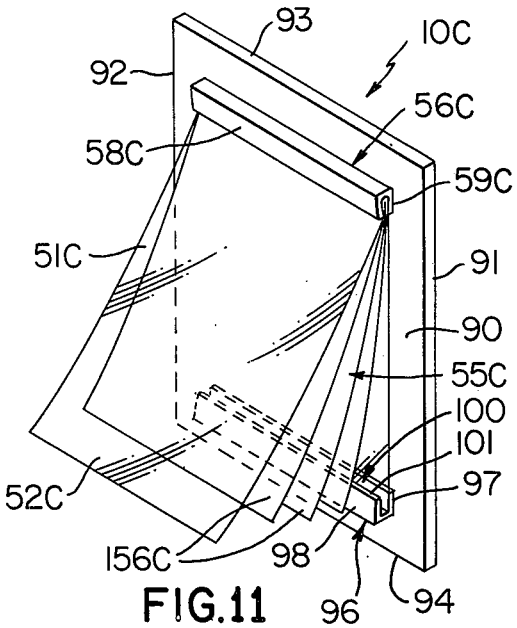
FIG. 11 is a side, perspective view of the frame construction of FIG. 10 and illustrates the manner of fanning out the various pages of the plural page document held thereby for individual viewing thereof.
Figure 12:
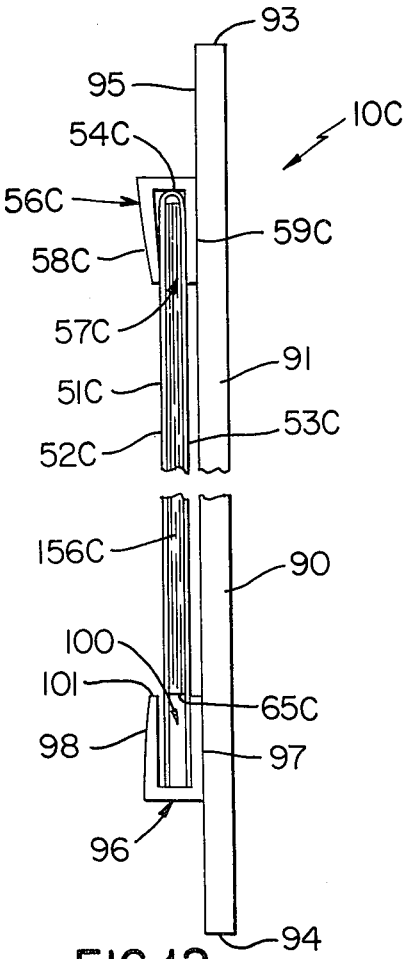
FIG. 12 is an enlarged, fragmentary, side view of the frame construction illustrated in FIG. 10 and is taken in the direction of the arrows 12—12 of FIG. 10.

As illustrated in FIGS. 10–12, the frame construction 10C includes a substantially flat rectangular plate 90 that defines a substantially rectangular open area 13C inwardly of the side edges 91 and 92 thereof as well as inwardly of the top and bottom edges 93 and 94 thereof.

A clamping channel member 56C, similar to the upper clamping channel means 12 previously described, has its back side 59C directly fastened to the front surface 95 of the plate 90 parallel to the top edge 93 thereof in the manner illustrated in FIGS. 10–12 to be permanently attached to the backing member 90. For example, such side 59C of the clamping member 56C can be adhesively fastened to the front surface 95 of the plate 90, or can be formed integrally therewith, if desired.

Another channel member 96, similar to the channel means 13, has its rear flange 97 directly secured to the front surface 95 of the plate 90 parallel and adjacent to the bottom edge 94 thereof as illustrated in the drawings or is formed integral therewith, if desired, the channel member 96 having its front flange 98 not normally biased toward the back flange 97 in the manner illustrated in FIG. 12 so the same normally assumes the open channel condition illustrated in FIG. 12.

Figure 13:
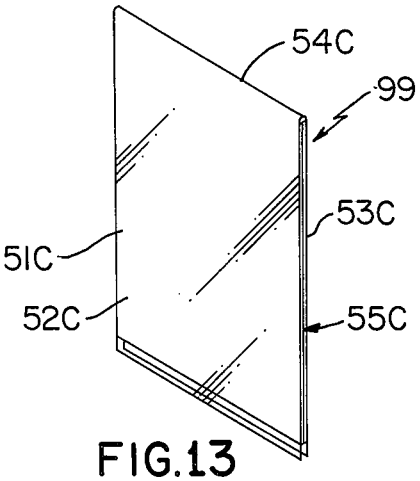
FIG. 13 is a side, perspective view of the carrier member for carrying the plural page document to be framed in the frame construction of FIG. 10.

The aforementioned folded transparent sheet 51C is utilized with the plural page document 55C so as to hold the individual stacked pages 156C of the plural page document 55C between the front sheet 52C and back sheet 53C thereof in the manner illustrated in FIG. 13 with the upper edges of the pages 156C being disposed closely adjacent the fold 54C of the transparent sheet means 51C to provide a carrier unit that is generally indicated by the reference numeral 99 in FIG. 13.

Figure 14:
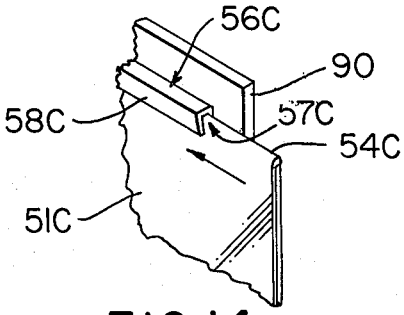
FIG. 14 is a view similar to FIG. 5 and illustrates the manner of inserting the carrier member of FIG. 13 into the frame construction of FIG. 10.

The carrier unit 99 is adapted to be inserted in the channels 56C and 96 of the frame construction 10C by having the fold portion 54C of the transparent sheet 51C inserted within the channel 57C of the upper clamping member 56C in the manner illustrated in FIG. 14 whereby the front flange 58C of the channel member 56C firmly holds the upper portion of the carrier unit 99 in the manner illustrated in FIGS. 10–12 while the lower portion of the sheets 52C and 53C are readily received in the channel 100 of the lower channel member 96, the lower edges 65C of the pages 156C being disposed closely adjacent the top edge 101 of the front flange 98 of the bottom channel members 96 in the manner illustrated in FIG. 12.

Thus, it can be seen that the carrier member 99 is firmly held in the window area 13C of the frame construction 10C by the upper clamping member 56C and the individual pages 156C can be fanned outwardly in the manner illustrated in FIG. 11 by merely removing the lower portion of the front transparent sheet 52C from the channel 100 of the lower channel member 96 in the manner previously described for individual viewing of the sheets 55C which can be subsequently moved back into stacked condition by reinserting the lower edge of the front transparent sheet 52C in the channel 100 of the lower channel member 96 as illustrated in FIG. 12.

Thus, it can be seen that the clamping channel means 56C of the frame construction 10C remains part of the same whereas the carrier unit 99 can be readily removed therefrom and a new carrier unit 99 inserted therein in the manner previously described for changing of the plural page document in the frame construction 10C if desired.

Also, it is to be understood that the plate 90 can be formed of wood or other composition as desired and can be hung from a wall in any suitable manner, such as with a wire hanger on the back of the same or by providing an eyelet means extending out of the top edge 93 thereof in a manner similar to a plaque or the like.

It is also to be understood that the channel member 96 can have the channel 100 thereof formed in a relatively shallow manner while still having an overall width similar to the upper clamping member 56C.

Figure 15:
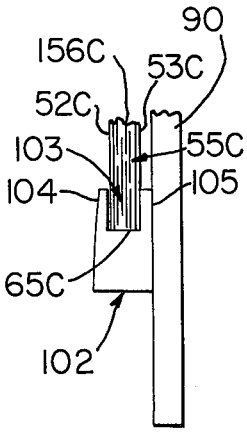
FIG. 15 is a fragmentary, bottom side view similar to FIG. 12 and illustrates another embodiment of this invention.

For example, such a lower channel member is indicated by the reference numeral 102 in FIG. 15 and has a relatively shallow channel 103 formed between the front and back flanges 104 and 105 thereof so that the lower edges 65C of the pages 156C of the plural page document 55C will be readily received in the same along with the lower portions of the front and back transparent sheets 52C and 53C while still permitting all of the same to be readily removed from the shallow channel 103 for fanning out of the same for viewing of the individual pages 156C in the manner previously described.

It is to be understood that in all of the frame constructions of this invention, the dimensions of the various parts thereof could be chosen to be most complementary to the particular size and shape of the plural page document being framed thereby. For example, a soft copy of an issued United States patent or issued foreign patent could be the particular plural page document being framed whereby the frame construction of this invention will permit such patent copy to have all the pages thereof readily reviewed when desired so that the same could be a working patent copy as well as a recognition or award copy displaying the inventor's creativity for others to appreciate. Also, the pages of an ordinary book could comprise the plural page document so that a true "picture book" would be provided.

If desired, a unit 11 of FIG. 3 could be fastened to the front surface 95 of the plate 90 to provide a frame construction similar to the frame construction 10C as the secured unit 11 could receive a plural page document therein in the same manner as the channels 56C and 96.

While any suitable material can be utilized for forming the sheet means 51 and 51C as well as the channel means 56C and 59 and the integral unit 11 that includes the channel means 12 and 13, one such combination of materials that would appear to be suitable would be the folded transparent sheet and the "Grip-Strip" (TM) backbone of the Joshua Meier Division of the W. R. Grace & Co., North Bergen, New Jersey, designated as Stock No. VBP-11 and sold under the trademark "Visi-Belle" of such company respectively for the sheet means 51 or 51C and the channel means 56C, 59 or unit 11.

While the forms of the invention now preferred have been disclosed and described as required by the Patent Statutes, it is to be understood that other forms may be utilized and still come within the scope of the appended claims.

What is claimed is:

1. A picture-like frame construction exhibiting a plural page document comprising a plural page document, a back support for supporting said frame construction in a substantially vertical manner on a wall, desk, etc., said back support having a clamping channel means adjacent the top thereof for defining at least part of an open area within said frame construction and leading from the front thereof to said back support and clamping and holding adjacent top parts of said pages in serial hinged stacked relation in the channel thereof so that said pages are disposed in serial stacked relation in said open area in such a manner that the outermost page appears to be the only page framed in the open area but permitting all of said pages to be manually fanned out through said open area thereof for individual viewing thereof, and a folded transparent flexible sheet receiving said top parts of said pages of said document in the fold thereof, said fold of said sheet being clamped in said channel of said clamping channel means whereby the outer part of said folded sheet covers the outermost page of said plural page document when the same are disposed in said stacked relation in said open area and tends to give the appearance that the same is a glass panel covering the outermost page of said document, said frame construction having another channel means adjacent the bottom of said back support and having the channel thereof facing toward the channel of the first mentioned channel means while being spaced below the bottom parts of said pages and loosely receiving the bottom edge of said outer part of said sheet to hold said sheet and the bottom parts of said pages in unfanned relation at the bottom thereof until it is desired to fan the same out through said open area by bowing said outer part of said sheet to remove the bottom edge thereof from its respective channel whereby once said outer part of said sheet has its bottom edge thereof removed from its respective channel all of the bottom parts of said pages are free to be fanned out of said open area as the same are spaced above the respective channel whereby the differential in length between said outer part of said sheet and said pages permits said sheet to lock said bottom parts of said pages in said unfanned relation when said outer part of said sheet is received in said respective channel.

2. A frame construction as set forth in claim 1 wherein said sheet has a back part disposed between the bottom page of said document and said back support, said back part of said sheet having the bottom edge thereof loosely received in said other channel to be held thereby.

3. A frame construction as set forth in claim 1 wherein said back support has an outer peripheral edge extending outwardly from said channel means to define a border about said open area.

4. A frame construction as set forth in claim 1 wherein said back support is integral with both of said channel means.

5. A frame construction as set forth in claim 1 wherein both of said channel means are separate from said back support and are secured to said back support.

6. A frame construction as set forth in claim 1 wherein said back support has a top edge and a bottom edge, said channel means respectively having parts thereof substantially coplanar with said edges of said back support.

7. A frame construction as set forth in claim 1 wherein said outer part of said folded sheet has means on the peripheral side edges thereof that tend to look like said channel means and cooperate with said channel means to tend to define a continuous border about said outermost page of said plural page document when said outer part and said pages are disposed in said unfanned relation in said open area.

* * * * *